United States Patent [19]

Geeck

[11] Patent Number: 5,009,516

[45] Date of Patent: Apr. 23, 1991

[54] SHOPPING CONTAINER DEVICE

[76] Inventor: Carol A. Geeck, 827 Plumosa, Vista, Calif. 92083

[21] Appl. No.: 572,680

[22] Filed: Aug. 27, 1990

[51] Int. Cl.[5] ..... B65D 30/10

[52] U.S. Cl. ..... 383/37; 383/4; 383/25; 383/43; 383/127; 383/71; 280/DIG. 4

[58] Field of Search ..... 383/4, 24, 25, 37, 43, 383/71, 2, 127; 206/37.1; 150/109, 111, 113, 116; 190/1, 108; 280/DIG. 3, DIG. 4

[56] References Cited

U.S. PATENT DOCUMENTS

| | | | |
|---|---|---|---|
| 1,399,576 | 12/1921 | Rettenmeyer | 150/109 |
| 1,606,107 | 11/1926 | Simms | 383/4 X |
| 2,038,952 | 4/1936 | Niedorff et al. | 383/4 X |
| 2,671,486 | 3/1954 | Shaw | 383/25 X |
| 4,085,873 | 4/1978 | Schweitzer | 383/2 X |
| 4,117,874 | 10/1978 | Berenguer | 383/4 X |
| 4,560,096 | 12/1985 | Lucas et al. | 280/DIG. 3 X |
| 4,782,874 | 11/1988 | Chartier | 383/4 X |
| 4,871,100 | 10/1989 | Posner | 280/DIG. 4 X |
| 4,944,042 | 7/1990 | DeWan | 190/1 X |

FOREIGN PATENT DOCUMENTS

| | | | |
|---|---|---|---|
| 94783 | 5/1922 | Switzerland | 383/24 |

*Primary Examiner*—Stephen P. Garbe
*Assistant Examiner*—Jes F. Pascua
*Attorney, Agent, or Firm*—John J. Murphey

[57] ABSTRACT

A shopping container device, including a first, storage bag-size, collapsible bag, having an open top and a closed bottom, a flexible, non-stretchable handle attached about the open top for carrying the bag when full, a second, smaller collapsible bag having a closed bottom and an openable top, with the top biased normally closed, a flexible tape joining the open top of the first bag to the inside of the second bag a short distance below its biased-closed top, the bottom of the second bag folded flat to form a short flap, the flap folded about one portion of a small ring and attached it itself to form a ring-holding closed loop and a normally closed, openable snap anchored to the ring for attachment to the user's vehicle ignition keys, the smaller second bag of an overall size sufficient to completely contain the first bag collapsed therein, and of a length sufficient to contain the ignition keys when the first bag is removed therefrom.

9 Claims, 1 Drawing Sheet

SHOPPING CONTAINER DEVICE

BACKGROUND OF THE INVENTION

1. Field Of The Invention

This invention pertains to the field of shopping containers such as shopping bags and the like. More particularly, the invention pertains to a reusable shopping bag that is conveniently stored in a small carrying bag, the carrying bag having a multiplicity of uses.

2. Description Of The Prior Art

Reusable shopping bags are known in the prior art. However, over the past years, there has been little, if any, use made of them, primarily because of the modernization of plastic and paper bag-making equipment that has resulted in the production of shopping bags that are of such low cost, they can be used once and then discarded.

However, environmental concerns of recent years have brought criticism to bear on the use of paper and plastic bags. It has been determined that plastic bags are not biodegradable and therefore constitute a continuing pollutant when placed in landfills, and require expensive processing equipment should the plastic be recycled for later use. Even using this recycle process, certain fumes and gases are created that constitute atmospheric pollution. With greater emphasis being placed upon saving lumber and wood resources, the use of paper, in bags, has also been criticized because of the number of trees it takes to provide sufficient starting material to make a large number of paper bags. Accordingly, attention is focused once more on the possibility of creating and marketing a shopping bag made of such material that it can be reused, and at the same time, not constitute an eye-sore when set aside at home or in the automobile for later use on the next shopping spree.

Combining a large shopping-bag size collapsible bag, with a smaller bag in which to contain the collapsed shopping bag, is not new in the art. Patents such as 1,606,107; 2,164,641; 2,493,085; 2,617,569; 2,871,900; 3,587,698; 4,085,873; and 4,782,874 are all examples of bags that in some fashion are foldable or carryable in other bags attached thereto.

Much of this prior art, however, was generated at a time when the shopper carried only a small purse into the store. With the small purse they could also carry with them the shopping bag stored in another bag and this would not constitute an unwieldy amount of material to be carried on a shopping spree. Modernly, however, the use of these prior art devices, in combination with the number of coupons that one carries in their purse or billfold, plus the large amount of keys one normally carries with them, would constitute a substantial burden on the shopper because of the sheer number of items to be carried on a shopping spree Further, there is a rise in overall crime and it is not uncommon for a shopper to have items taken, removed or otherwise stolen from the shopping cart during the shopping spree. Still further, most shopping in food stores is done with the use of shopping carts that are maneuvered on wheels throughout the various aisles. It is not uncommon for a shopper to leave the shopping cart, go to another aisle and return with an item to place in the shopping cart, only to discover that someone has taken their bag and left with it, containing all the items.

Still further, the prior art devices consisted of either very loosely woven net bags or of heavy canvas or plastic-coated bags. The net bags cannot safely carry small items—they may easily fall through the netting The heavier bags constitute an item that must be carried, empty or full, and often become a nuisance when not in use.

Accordingly, there clearly appears to be a continuing need for a shopping container device that has the ability to be stored in a convenient locale when not in use, joined with other items of personal property such as vehicle ignition keys, and further can be temporarily attached to the interior of the shopping cart when utilized in the store.

SUMMARY OF THE INVENTION

This invention is a shopping container device that satisfies the modern requirements of a reusable shopping bag that remain unsatisfied by the prior art. The shopping bag of this invention is made of very thin, preferably rip-stop-type material so as to allow it be a rather large, shopping-size bag collapsible into a very small volume when not in use. The shopping bag is uniquely attached to a second, smaller container bag in which the shopping bag may be stored when not in use. When, however, the shopping bag is withdrawn from the container bag, the container bag may be utilized to store one's vehicle keys therein during the shopping spree so that, when leaving the store, one does not have to rummage through their purse or through their pockets looking for the vehicle ignition key but merely reach down and extract them from this small carrying container. It is the unique way that the bags are attached together that provides this function Further, the invention includes a snap, uniquely attached to the small storage bag for snapping to the interior of the shopping cart during the shopping spree to prevent the others from lifting the bag completely out of the shopping cart and walking off with one's items to be purchased.

The invention takes the form of a small bag containing the collapsed shopping bag that is attached to a snap ring that may be conveniently attached to one's ignition keys so that when one proceeds to the shopping area, the vehicle ignition keys, the storage bag and the shopping bag are conveniently connected together to reduce the amount of extraneous material that must be carried in the purse, pockets or otherwise, by the shopper Further, the shopping bag of this invention is preferably made in a configuration that lends itself to low-cost production as well as able to carry heavy loads.

The main object, therefore, of this invention is a unique shopping container device that utilizes a collapsible shopping bag in a combination with a storage bag and an openable snap that combines to provide a convenient device for use by the shopper both when leaving the vehicle and entering the store and leaving the store to enter the vehicle. Other objects of the invention include a collapsible bag made of a highly modern rip-stop material allowing the bag to contain and carry an enormous amount of items without breaking as would occur in the use of paper bags and some plastic bags. Other objects include a device that conveniently allows one to keep the vehicle ignition keys attached to the shopping bag and housed in the protective bag so that the keys are not lost and amenable to easy and swift extraction when leaving the store and approaching one's vehicle. Finally, a specific object of this inventive device is to reduce environmental pollution caused by the discarding of plastic bags and to reduce the strain on the wood industry to provide wood pulp to make the paper bags that are now used in the shopping industry.

These and other objects of the invention will become more apparent upon reading the description of the preferred embodiment taken together with the drawings appended hereto. The scope of protection sought by the inventor maybe gleaned from a fair reading of the claims that conclude this specification.

DESCRIPTION OF THE PREFERRED EMBODIMENT

Figure 1:
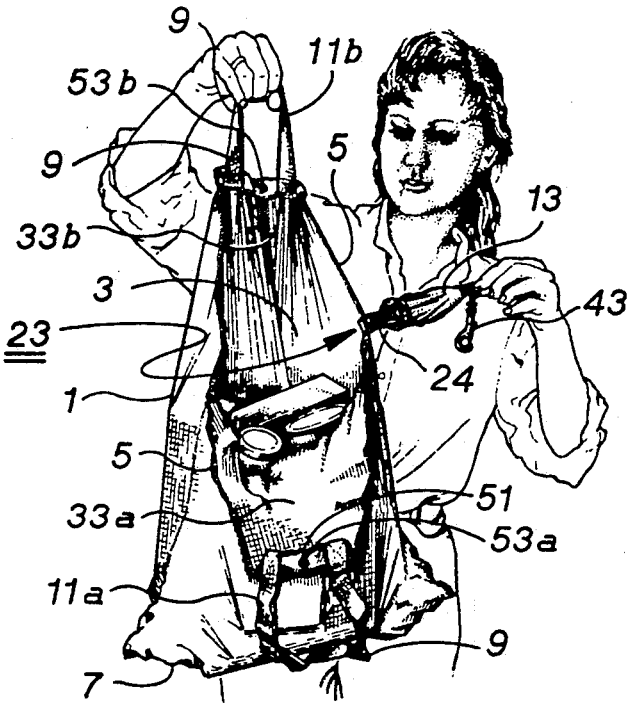
FIG. 1 is an illustrative view of the embodiment shown in FIG. 2 fully opened to show the shopping bag in combination with the other elements.

Turning now to the drawings wherein like elements are identified with like numerals throughout the six figures, FIG. 1 shows the overall view of the shopping container device of this invention and shows a first-bag 1 of a size similar to that of a shopping bag or storage bag, having an open top 3, defined by a periphery 5, and a closed bottom 7 that is carried by a handle, generally indicated at 9. Handle 9 is most conveniently formed by a pair of half-loops of flat, woven material such as nylon tape 11*a* and 11*b*, the free ends of each said loop attached to opposite sides of first-bag open top 3 about periphery 5.

Figure 4:
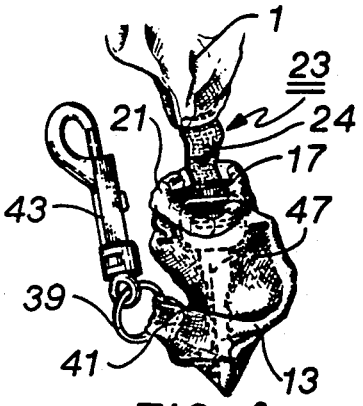
FIG. 4 is an illustrative view, partly in hidden line, of the small second-bag of the invention shown containing free vehicle ignition keys for use during a utilization of the device.

A smaller, second-bag 13 is shown having a closed bottom 15 and an openable top 17 that is biased closed by a small, closed loop 19 of elastic material stitched or otherwise attached about the periphery 21 thereof. Means 23 is provided to attach bag 1 at its periphery 5 to the interior of bag 13. As shown in FIGS. 1 and 4, means 23 is preferably a short length of woven, flat tape 24 such as woven nylon tape, stitched at one end to bag periphery 5 and at the other end to the inside of bag 13 a spaced distance below its periphery 21.

Figure 2:
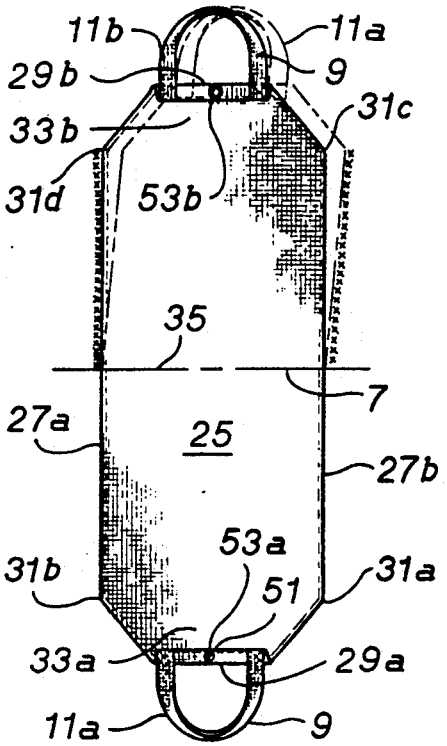
FIG. 2 is an illustrative flat pattern/phantom view of the preferred configuration of the large bag of this invention.

Referring now to FIG. 2, first-bag 1 is preferably formed from an elongated panel or sheet 25, of film-like material, that is defined by a pair of spaced-apart parallel, preferably straight, edges 27*a* and 27*b* and a pair of mutually spaced-apart end edges 29*a* and 29*b*, said side edges and end edges forming spacedapart corners 31*a*, 31*b*, 31*c* and 31*d*. Panel end edges 29*a* and 29*b* are shown angled outward from their respective corners 31*a*–31*b* and 31*c*–31*d* toward the center of said end edges forming a pair of spaced-apart flaps 33*a* and 33*b*. Panel 25 is shown in phantom outline to be folded over a phantom transverse center line 35, upon itself, so that side edge 27*a* is doubled back upon itself, as is side edge 27*b* and flaps 33*a* and 33*b* lie atop each other, as shown in phantom outline, and thereafter, said respective side edges joined together by stitching, as shown by the small "x's", or other known joinder means up to corners 31*abcd* to form first-bag 1 wherein end edges 29*a* and 29*b* form periphery 5; the opening therebetween forms open top 3 and the fold about phantom centerline 35 forms closed bottom 7. This construction is efficient because it reduces the amount of stitching required to form the bag. In addition, the lack of stitches in closed bottom 7 allows bag 1 to support a substantial weight of items.

In this embodiment, half-loops 11*a* and 11*b* are located astride, or on both sides of the center point of end-edges 29*a* and 29*b*, and are fixed to said end-edges by stitching or other known joinder means. It may be desirable to sew or otherwise attach a strip of reinforcing material along end-edges 29*a* and 29*b* to provide reinforcement and support for half-handle loops 11*a* and 11*b*, and such modification is fully contemplated within the spirit and scope of this invention.

Figure 3A:
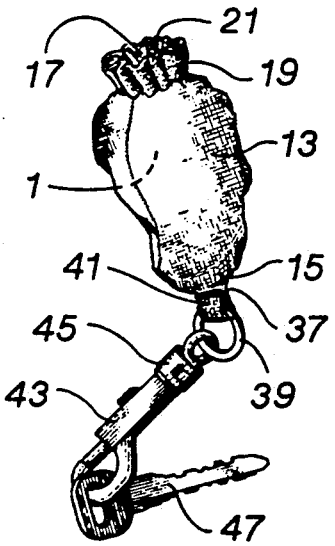
FIGS. 3*a* and 3*b* are illustrative views of the shopping container device of this invention in fully collapsed and stowed configuration.

Referring now to FIG. 3*a*, second-bag 13 is shown to fully surround and contain first-bag 1 when fully collapsed and stowed inside thereof. Because flexible means 23 is attached inside second-bag openable-top 17, second-bag 13 is fully closed when bag 1 is collapsed and placed inside of it. Second-bag closed-bottom 15 is folded flat to form a short flap 37 and folded about one circumferential portion or arc of a small ring 39, onto itself, and reattached to itself to form ring-holding closed-loop 41. The attachment of flap 37 upon itself to form loop 41 may be made by a variety of means including stitching, adhesives openable snaps and others, well-known in the art. Small ring 39 is preferably made from either strong plastics or metals such as brass or aluminum.

Figure 3B:
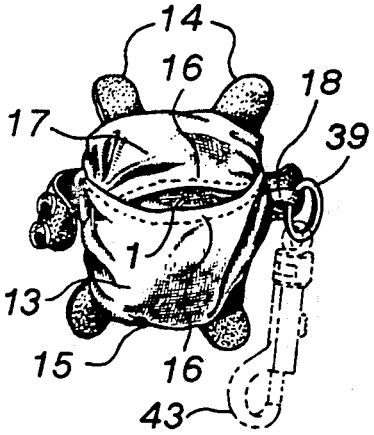

As shown in FIG. 3*b*, bag 13 may take on a variety of configurations. As shown, a plurality of tabs 14 are sewn or otherwise attached to said bag 13 to simulate a turtle or other toy animal. In this case, openable top 17 is formed by a pair of overlapping flaps 16 formed in one portion of bag 13 and ring 39 may be attached thereto by a short loop 18 of elastic material sewn into the bag main seam.

Figure 6:
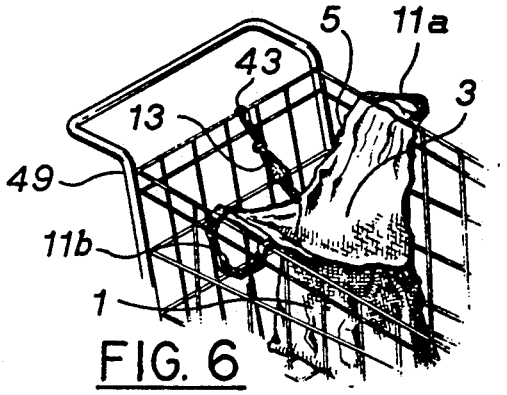
FIG. 6 is an illustrative view of the invention mounted temporarily in a shopping cart.

A normally closed, openable snap 43 is attached at its swivel base 45 to ring 39 and arranged for attachment to a variety of items As shown in FIG. 3, snap 43 is attached to a vehicle ignition key 47 so that the key maY be inserted in the vehicle ignition, thus allowing a person to drive to the store with their shopping bag handy for use in the store. As shown in FIG. 6 snap 43 may be temporarily engaged to or snapped about the upper spoke or rung of a shopping cart 49 to support bag 1 in an open position upright in cart 49 while the shopper fills bag 1 with items. Snap 43 is preferably of the type containing a swivel at base 45 to allow snap 43 to be rotated with respect to small second-bag 13.

A unique feature of this invention is that after first-bag 1 is withdrawn from second-bag 13, vehicle ignition key 47 may be placed in small bag 13 and fully contained therein in a safe position because of the biasing feature of closed-loop 19 of elastic material that will retain bag 13 closed. When exiting the market, the shopper need not rummage through purse or pockets to find ignition key 47, but simply reaches into small bag 13 to withdraw the key therefrom, thereby reducing the amount of confusion in accessing the vehicle.

Figure 5:
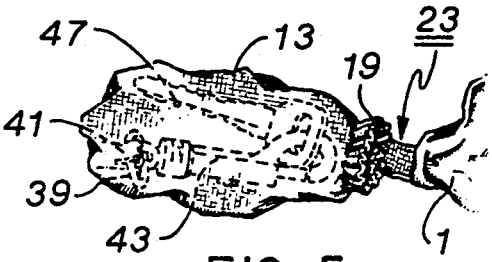
FIG. 5 is another illustrative view, also partly in hidden line, of the small bag containing the vehicle ignition key attached to the openable snap housed in the small, second-bag.

FIG. 5 shows the ignition key 47, still attached to snap 43, turned and placed inside of second-bag 13 by reversing bag 13 upon itself so that the key is retained in full connection with ring 39 throughout the use of the invention.

Bag 1 is preferably made of film-like material containing a lattice-work of thin, strong filaments to aid in supporting the weight of items placed in the bag and yet allow collapse of the bag to a small volume. Such material is presently available under the name, "rip-stop" nylon and comprises a very thin, nylon, film-like cloth containing a loose weave of thin, strong, nylon filaments. Second-bag 13 is preferably made of a material comprising a tightly-woven elastic thread. The whole bag is therefore stretchable and, when made into the form of a small bag 13, aids in retaining collapsed bag 1 in a very small volume. Such material is currently available under the name, "SPANDEX"(Trademark). Both bags being constructed of film-like material contain large areas for application of advertising such as by the store selling the invention.

As another embodiment of this invention, an openable snap 51 comprising interfittable male and female snap elements 53*a* and 53*b* may be attached on opposite edges of flaps 33*a* and 33*b* of first-bag periphery 5, preferably between handle half-loops 11*a* and 11*b* to aid in temporarily closing first-bag open-top 3 when the shopper is carrying items home from the store.

What is claimed is:

1. A shopping container device, comprising:

(a) a first, storage bag-size, collapsible bag, having an open top and a closed bottom;

(b) a flexible, non-stretchable handle attached about said open top for carrying said bag when full;

(c) a second, smaller collapsible bag having a closed bottom and an openable top, said top biased normally closed;

(d) flexible means joining said open top of said first-bag to the inside of said second-bag a short distance below its biased-closed top;

(e) said bottom of said second-bag folded flat to form a short flap;

(f) said flap folded about one portion of a small ring and attached to itself to form a ring-holding closed loop; and, (g) a normally closed, openable snap anchored to said ring for attachment to a user's vehicle ignition keys;

(h) said smaller second-bag of an overall size sufficient to completely contain said first-bag collapsed therein, and of a length sufficient to contain the ignition keys when said first-bag is removed therefrom.

2. The shopping container device of claim 1 wherein said smaller second-bag is biased closed by a loop of elastic material attached about said openable top.

3. The shopping container device of claim 1 wherein said smaller second-bag is biased closed by the formation of overlapping lips formed in said second bag.

4. The shopping container device of claim 1 wherein said first collapsible bag is constructed of rip-stop material.

5. The shopping container device of claim 1 wherein said second collapsible bag is construction of elastic material.

6. The shopping container device of claim 1 wherein said first-bag is formed from an elongated panel of film-like material bounded by a pair of spaced-apart, parallel straight side edges and a pair of mutually spaced-apart end edges intersecting said side edges to form spaced-apart corners, each said end edge bowed outward from its respective center away from said panel to form a pair of spaced-apart flaps, wherein said panel is folded over onto itself to bring said side edges onto itself and bound therealong to form the bag with said flaps forming the upper side of said bag.

7. The shopping container device of claim 6 including a pair of half-loops of flexible material, the mutual terminal ends of each attached to the center of one of said flaps to be held together in mutual alignment as a handle to carry said bag.

8. The shopping container device of claim 1 wherein said normally closed, openable snap is a spring-loaded snap.

9. The shopping container device of claim 8 wherein said spring-loaded snap is a swivel snap.

* * * * *